US012196515B1

(12) United States Patent
Mantas

(10) Patent No.: US 12,196,515 B1
(45) Date of Patent: Jan. 14, 2025

(54) RECOIL MECHANISM FOR A FIREARM

(71) Applicant: Dimitrios Mantas, Athens (GR)

(72) Inventor: Dimitrios Mantas, Athens (GR)

( * ) Notice: Subject to any disclaimer, the term of this patent is extended or adjusted under 35 U.S.C. 154(b) by 16 days.

(21) Appl. No.: 18/220,127

(22) Filed: Jul. 10, 2023

(51) Int. Cl.
*F41A 25/12* (2006.01)

(52) U.S. Cl.
CPC ..... *F41A 25/12* (2013.01)

(58) Field of Classification Search
CPC ..... F41A 3/70; F41A 3/12; F41A 3/80; F41A 3/84; F41A 3/86; F41A 25/12; F41A 3/82; F41A 3/78; F41A 3/94; F41A 3/26; F41C 23/06; F41C 23/08; F41C 23/14
See application file for complete search history.

(56) References Cited

U.S. PATENT DOCUMENTS

| | | | | |
|---|---|---|---|---|
| 1,019,937 | A | 3/1912 | Whittier | |
| 1,360,873 | A | 11/1920 | Nils | |
| 1,367,354 | A | 2/1921 | Craig | |
| 1,457,961 | A | 6/1923 | Browning | |
| 1,788,279 | A | 1/1931 | Cutts | |
| 1,877,839 | A | 9/1932 | Rudolf | |
| 2,286,133 | A | 6/1942 | Williams | |
| 2,379,461 | A | 7/1945 | Simpson | |
| 2,426,661 | A | 9/1947 | Anderson | |
| 2,456,652 | A | 12/1948 | Simpson | |
| 2,504,958 | A | 4/1950 | Botts | |
| 2,779,249 | A | 1/1957 | Erik | |
| 2,788,714 | A | 4/1957 | Browning | |
| 2,791,945 | A | 5/1957 | Maier | |
| 2,831,404 | A | 4/1958 | Sampson | |
| 2,866,389 | A | 12/1958 | Simpson | |
| 2,900,877 | A | 8/1959 | Sloan | |
| 2,973,694 | A | 3/1961 | Friedrich | |
| 3,082,667 | A | 3/1963 | Ramseyer | |
| 3,251,270 | A | 5/1966 | Seifried | |
| 3,366,011 | A | 1/1968 | Sturtevant | |
| 3,371,442 | A | 3/1968 | Carlson | |
| 3,517,586 | A | 6/1970 | Stoner | |
| 3,603,577 | A | 9/1971 | Deraad | |
| 3,707,797 | A * | 1/1973 | Ruth | F41C 23/06 42/74 |

(Continued)

FOREIGN PATENT DOCUMENTS

| | | | |
|---|---|---|---|
| FR | 1088428 | A | 3/1955 |
| FR | 1151326 | A | 1/1958 |
| WO | 1996015416 | A1 | 5/1996 |

*Primary Examiner* — Michael D David
(74) *Attorney, Agent, or Firm* — Notaro, Michalos & Zaccaria P.C.

(57) ABSTRACT

A recoil mechanism has a hollow cylinder having a first portion adjacent to a closed end having a first inner diameter and a second portion adjacent to an open end having a second inner diameter, and an outwardly facing flange at the open end thereof. An outer spring is positioned over the hollow cylinder and has a second end in contact with the outwardly facing flange. A rod assembly includes a rod coupled to an endplate at a first end thereof and an enlarged portion towards a second end thereof, a washer mounted on the rod between the enlarged portion and the endplate, and a rod spring mounted over the rod between the small washer and the endplate. Moreover, the rod assembly is positioned within the hollow cylinder by inserting the second end of the rod into the open end of the hollow cylinder.

20 Claims, 4 Drawing Sheets

(56) References Cited

U.S. PATENT DOCUMENTS

| | | | | |
|---|---|---|---|---|
| 3,731,590 | A | 5/1973 | Zimmerman | |
| 3,901,125 | A | 8/1975 | Raville | |
| 4,000,217 | A | 12/1976 | Radici | |
| 4,028,993 | A | 6/1977 | Reynolds | |
| 4,031,808 | A | 6/1977 | Raville | |
| 4,057,003 | A | 11/1977 | Atchisson | |
| 4,150,819 | A | 4/1979 | Taylor | |
| 4,201,113 | A | 5/1980 | Seecamp | |
| 4,307,653 | A | 12/1981 | Goes | |
| 4,439,943 | A | 4/1984 | Brakhage | |
| 4,485,723 | A | 12/1984 | Sarony | |
| 4,558,628 | A | 12/1985 | Bosshard | |
| 4,667,566 | A | 5/1987 | Bosshard | |
| 4,677,897 | A | 7/1987 | Barrett | |
| 4,754,689 | A | 7/1988 | Grehl | |
| 4,972,760 | A | 11/1990 | McDonnell | |
| 5,054,368 | A | 10/1991 | Wentzel | |
| 5,069,110 | A | 12/1991 | Menck | |
| 5,279,202 | A | 1/1994 | Bellardi | |
| 5,392,553 | A | 2/1995 | Carey | |
| 5,513,730 | A | 5/1996 | Petrovich | |
| 5,710,389 | A | 1/1998 | Canaday | |
| 5,909,002 | A | 6/1999 | Atchisson | |
| 6,715,399 | B2 * | 4/2004 | Barrett, Jr. | F41A 3/46 89/182 |
| 6,758,126 | B1 | 7/2004 | Houtsma | |
| 6,829,974 | B1 | 12/2004 | Gwinn, Jr. | |
| 7,124,529 | B1 | 10/2006 | Havelka, Jr. | |
| 7,131,367 | B1 | 11/2006 | Boerschig | |
| 7,261,029 | B1 | 8/2007 | Davis | |
| 7,478,495 | B1 | 1/2009 | Alzamora | |
| 7,493,845 | B2 | 2/2009 | Mantas | |
| 7,793,453 | B1 | 9/2010 | Sewell, Jr. | |
| 8,210,090 | B2 | 7/2012 | Brown | |
| 8,296,984 | B2 | 10/2012 | Kincel | |
| 8,297,176 | B2 | 10/2012 | Buschow | |
| 8,430,015 | B2 | 4/2013 | Faifer | |
| 8,757,338 | B2 | 6/2014 | Miyasato | |
| 8,800,424 | B2 | 8/2014 | Gangl | |
| 8,939,059 | B2 | 1/2015 | Coffman, II | |
| 8,997,954 | B2 | 4/2015 | Rodenbeck | |
| 9,080,823 | B1 | 7/2015 | Mantas | |
| 9,267,747 | B2 | 2/2016 | Caudle | |
| 9,341,437 | B1 | 5/2016 | Huang | |
| 9,347,738 | B1 | 5/2016 | Schumacher | |
| 9,651,323 | B1 | 5/2017 | Mantas | |
| 9,739,566 | B2 | 8/2017 | Huang | |
| 9,879,930 | B2 * | 1/2018 | Cassels | F41A 3/84 |
| 9,915,492 | B2 | 3/2018 | Huang | |
| 9,921,013 | B1 | 3/2018 | Oglesby | |
| 9,970,722 | B1 | 5/2018 | Babb | |
| 10,006,739 | B2 | 6/2018 | Pollutro | |
| 10,054,378 | B2 | 8/2018 | Pawlowski | |
| 10,352,637 | B1 * | 7/2019 | Geissele | F41A 3/84 |
| 10,415,907 | B1 * | 9/2019 | Kincel | F41A 3/84 |
| 10,557,674 | B1 | 2/2020 | Mantas | |
| 10,619,956 | B1 * | 4/2020 | Zhang | F41A 3/84 |
| 10,712,108 | B2 * | 7/2020 | Cozad | F41A 3/84 |
| 10,852,083 | B2 * | 12/2020 | Underwood | F41A 3/84 |
| 11,378,347 | B2 * | 7/2022 | Kincel | F41A 3/84 |
| 2002/0053156 | A1 | 5/2002 | McCarthy | |
| 2003/0150322 | A1 * | 8/2003 | Barrett, Jr. | F41A 3/46 89/182 |
| 2003/0154640 | A1 | 8/2003 | Bragg | |
| 2004/0103777 | A1 | 6/2004 | Moore | |
| 2005/0246931 | A1 | 11/2005 | Poff | |
| 2006/0236853 | A1 | 10/2006 | Boersching | |
| 2008/0110074 | A1 | 5/2008 | Bucholtz | |
| 2008/0178508 | A1 | 7/2008 | Cinciu | |
| 2009/0001636 | A1 | 1/2009 | Miyasato | |
| 2009/0095584 | A1 | 4/2009 | Kondo | |
| 2010/0050492 | A1 | 3/2010 | Faifer | |
| 2010/0071246 | A1 | 3/2010 | Vesligai | |
| 2010/0122482 | A1 | 5/2010 | Simms | |
| 2010/0140031 | A1 | 6/2010 | Miyasato | |
| 2010/0281727 | A1 | 11/2010 | Quaedpeerds | |
| 2011/0101585 | A1 | 5/2011 | Kamae | |
| 2011/0138668 | A1 | 6/2011 | Thomas | |
| 2011/0179687 | A1 | 7/2011 | Caravaggi | |
| 2012/0297656 | A1 | 11/2012 | Langevin | |
| 2013/0319217 | A1 * | 12/2013 | Gangl | F41A 3/84 89/198 |
| 2014/0059909 | A1 | 3/2014 | Caudle | |
| 2014/0075798 | A1 | 3/2014 | Kincel | |
| 2015/0330728 | A1 * | 11/2015 | McGinty | F41A 3/84 89/198 |
| 2016/0010944 | A1 | 1/2016 | Downey | |
| 2017/0059264 | A1 * | 3/2017 | Geissele | F41A 3/84 |
| 2017/0067716 | A1 | 3/2017 | Huang | |
| 2017/0122682 | A1 * | 5/2017 | Mantas | F41A 3/86 |
| 2017/0130799 | A1 | 5/2017 | Spyche, Jr. | |
| 2017/0205164 | A1 * | 7/2017 | Cassels | F41A 3/84 |
| 2017/0299295 | A1 * | 10/2017 | Pawlowski | F41A 3/84 |
| 2017/0314886 | A1 | 11/2017 | Huang | |
| 2018/0010870 | A1 * | 1/2018 | Mantas | F41A 3/86 |
| 2018/0224227 | A1 | 8/2018 | Durham, III | |
| 2018/0245866 | A1 * | 8/2018 | Geissele | F41A 3/84 |
| 2020/0096269 | A1 * | 3/2020 | Cozad | F41A 3/84 |
| 2020/0182569 | A1 * | 6/2020 | Underwood | F41A 3/84 |
| 2021/0025665 | A1 * | 1/2021 | Kincel | F41A 3/84 |

* cited by examiner

RECOIL MECHANISM FOR A FIREARM

FIELD

The present disclosure relates generally to the field of firearms and in particular to a recoil mechanism for short action firearms that manages the recoil forces generated upon discharged of the firearm.

BACKGROUND OF THE INVENTION

A recoil mechanism provides a way to reduce the recoil of a firearm caused as a reaction to being fired (discharged). The firearm is a mechanical system that, when discharged, causes a bullet to travel along the barrel and exit via the muzzle. The discharge of the firearm causes a resulting reactive force that is imparted to the firearm in the form of recoil. In addition, the explosion produced to propel the bullet causes an instantaneous kinetic energy applied to the frame of the firearm. Recoil springs are commonly used as a mechanism to dampen the recoil effect. Conventional recoil mechanisms can be complex, bulky, heavy, difficult to maintain, and have limited ability for customization.

There is a need for further improvements in recoil mechanisms in terms of more optimal operation or modification thereof.

BRIEF DESCRIPTION OF THE DRAWINGS

The following detailed description, given by way of example and not intended to limit the present disclosure solely thereto, will best be understood in conjunction with the accompanying drawings in which.

DESCRIPTION OF THE PREFERRED EMBODIMENTS

In the present disclosure, like reference numbers refer to like elements throughout the drawings, which illustrate various exemplary embodiments of the present disclosure.

Figure 1:
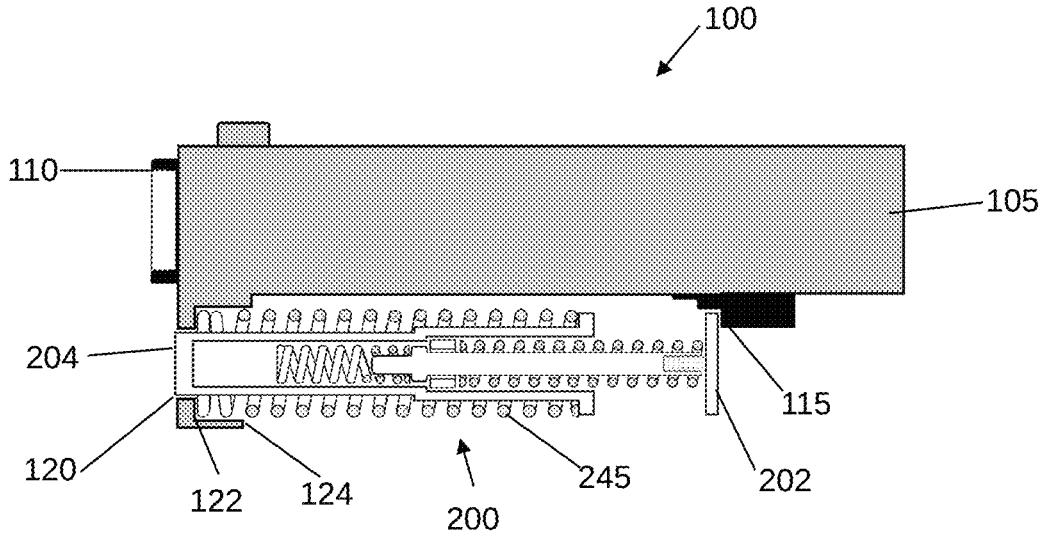
FIG. 1 is a side partial cut-away view of a recoil mechanism according to the present disclosure mounted to the slide portion of a firearm.

Referring now to FIG. 1, a recoil mechanism 200 for a firearm 100 is shown mounted on a slide 105 (shown separated from the frame) with a first end 204 of the recoil mechanism 200 positioned in an aperture 120 of the slide 105 and a second end 202 of the recoil mechanism 200 mounted against a barrel base 115 that is fixed to the barrel 110 for the firearm. A distal end of outer spring 245 of the recoil mechanism 200 is positioned against an inner surface 122 of the slide 105 in slot formed in part by a member 124.

Figure 2:
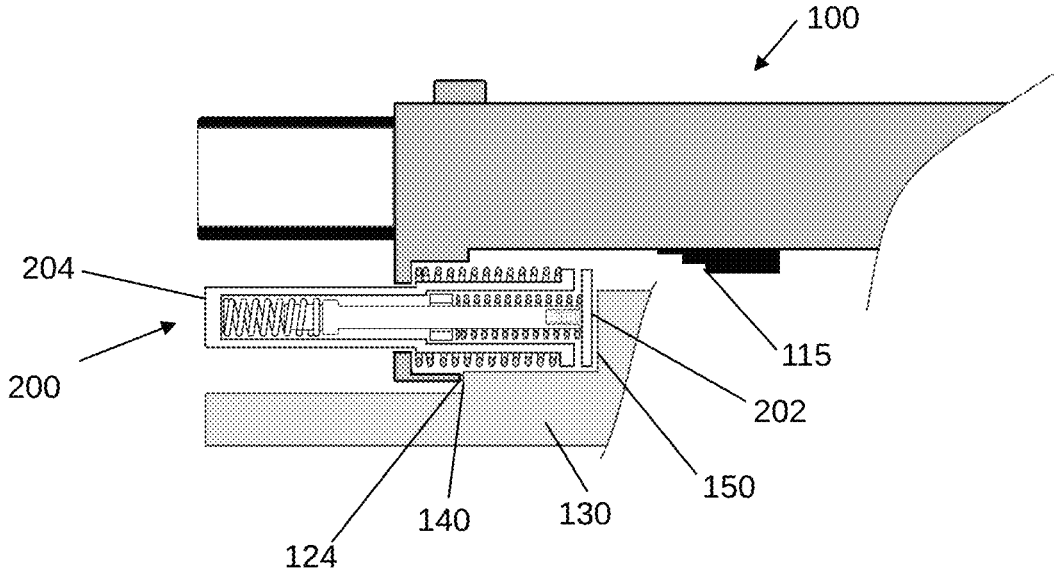
FIG. 2 is a side partial cut-away view of the recoil mechanism according to the present disclosure after being engaged with the firearm and in a fully compressed position as occurs after discharge.

Referring now to FIG. 2, the recoil mechanism 200 is shown mounted to a frame 130 of firearm 100 (and in a compressed form as would happen after discharge of the firearm 100 due to the force of the gases generated in the barrel 110 and on the slide 105 pushing the slide 105 backwards). The second end 202 of the recoil mechanism 200 becomes positioned against an internal surface 150 of frame 130 when the slide 105 and recoil mechanism 200 are mounted to frame 130. The slide 105 moves backwards until an inner surface of member 124 reaches a frame slide stop surface 140, compressing the three springs that make up recoil mechanism 200 (as explained below).

Figure 3:
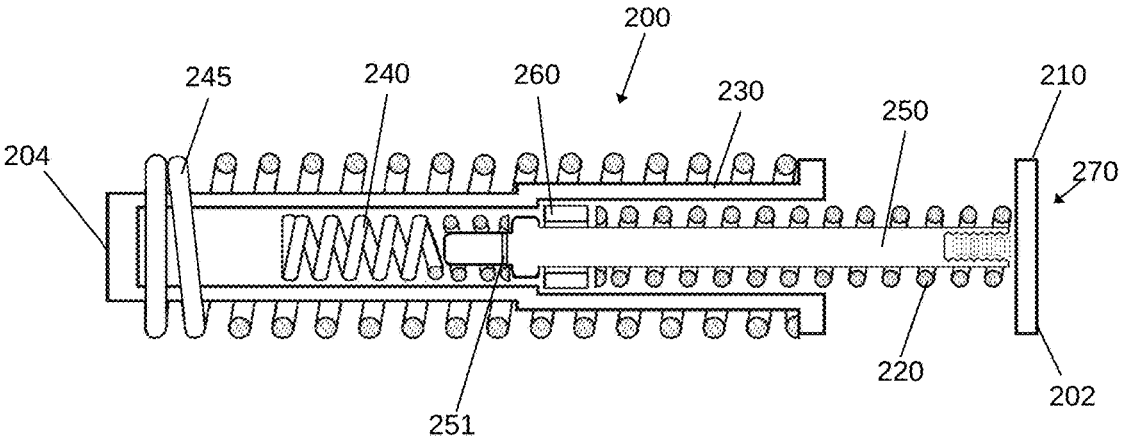
FIG. 3 is a side partial cut-away view of the assembled recoil mechanism according to the present disclosure shown disengaged from the firearm.
Figure 4:
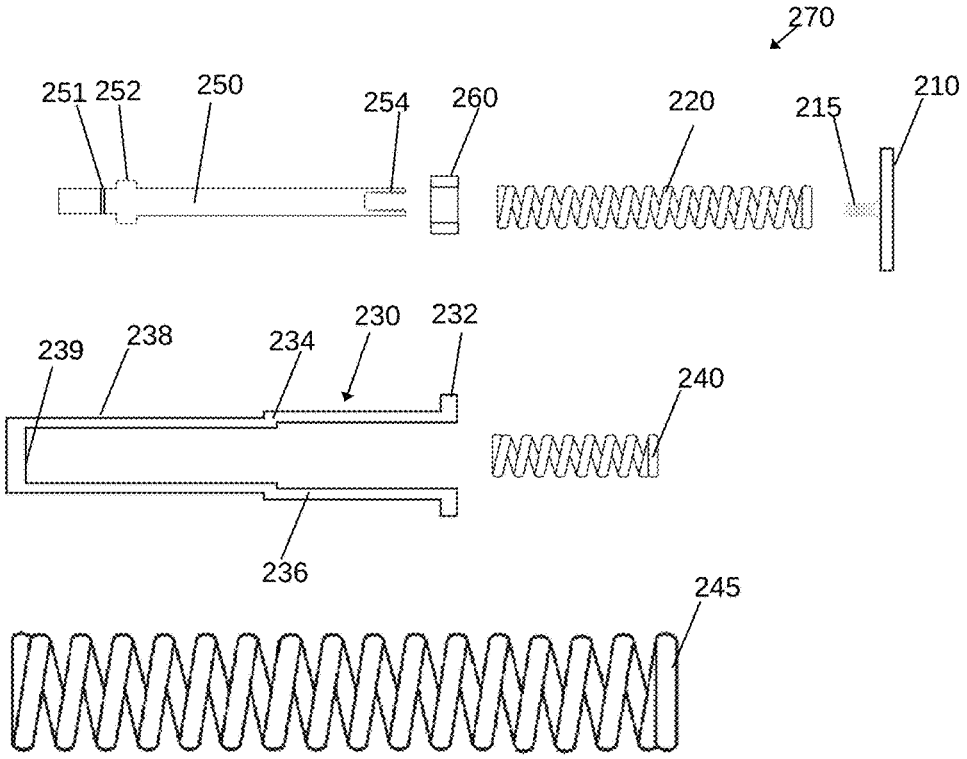
FIG. 4 is a side partial cut-away view of the recoil mechanism according to the present disclosure shown disassembled.

Referring now to FIGS. 3 and 4, the recoil mechanism 200 has an outer spring 245 that is mounted around a hollow cylinder 230. The hollow cylinder 230 closed at the first end 204 having an internal end surface 239 and an open end adjacent to an outward extending flange 232. A proximal end of outer spring 245 is in contact with the flange 232. The hollow cylinder 230 has two portions, a narrower portion 238 having a first inner diameter and a wider portion 236 having a second inner diameter (the second inner diameter larger than the first inner diameter), and a step 234 (internal flange) between the narrower portion 238 and the wider portion 236. The outer spring 245 has an inner diameter that is about the same as the outer diameter of the wider portion 236 of the hollow cylinder 230 so that the outer spring 245 is held tightly to the hollow cylinder 230 when positioned thereon as shown in FIG. 3. An inner spring 240 may positioned within the narrower portion 238 of the hollow cylinder 230. In some cases, the inner spring 240 may be omitted to provide an extra soft configuration. A rod assembly 270 is inserted into the open end of the hollow cylinder 230 as shown in FIG. 3. The rod assembly 270 includes a rod 250, a small washer 260, a rod spring 220 and an endplate 210. The endplate 210 has a threaded extension 215 on one side thereof that mates with a threaded aperture 254 at a proximal end of rod 250. The rod 250 is cylindrical with an enlarged portion 252 having a wider diameter towards the distal end thereof. A 251 or equivalent may be provided between the enlarged portion 252 of rod 250 and the distal end thereof. The slot 251 (or equivalent) is adapted to engage with an end coil of inner spring 240 to securely hold the inner spring 240 on the rod 250. A small washer 260 mounts over the rod 250 and has a narrower internal diameter than the outer diameter of the enlarged portion 252 of the rod 250, so that the small washer 260 cannot move any further distally than the enlarged portion 252 (see FIG. 2). The rod spring 220 has a diameter that is about the same diameter (or slightly smaller) than the outer diameter of the small washer 260 so that rod spring can be compressed proximally against the endplate 210 when the endplate 210 is mounted to rod 250 and pressure is applied in a proximal direction to the small washer 260.

Figure 5:
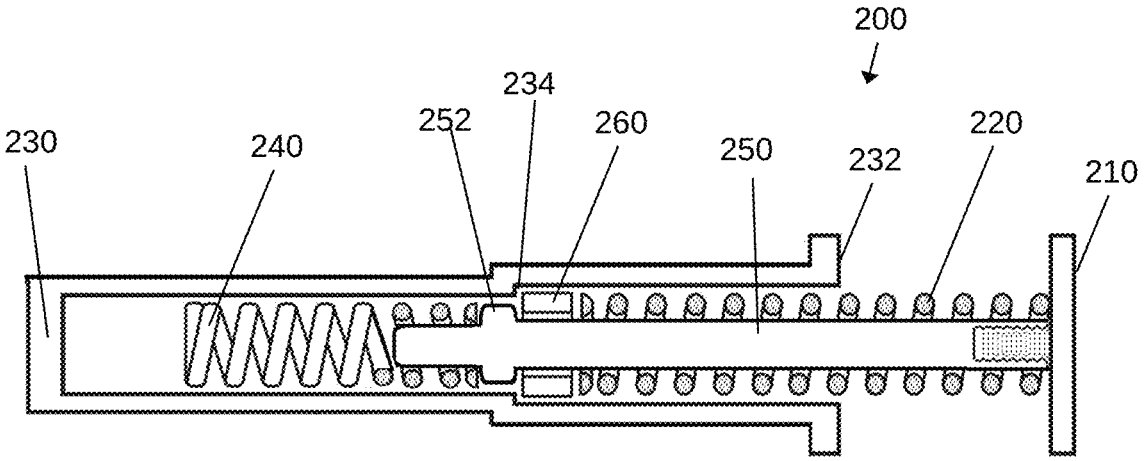
FIG. 5 is a side partial cut-away view of the assembled recoil mechanism according to the present disclosure shown in an uncompressed form.
Figure 6:
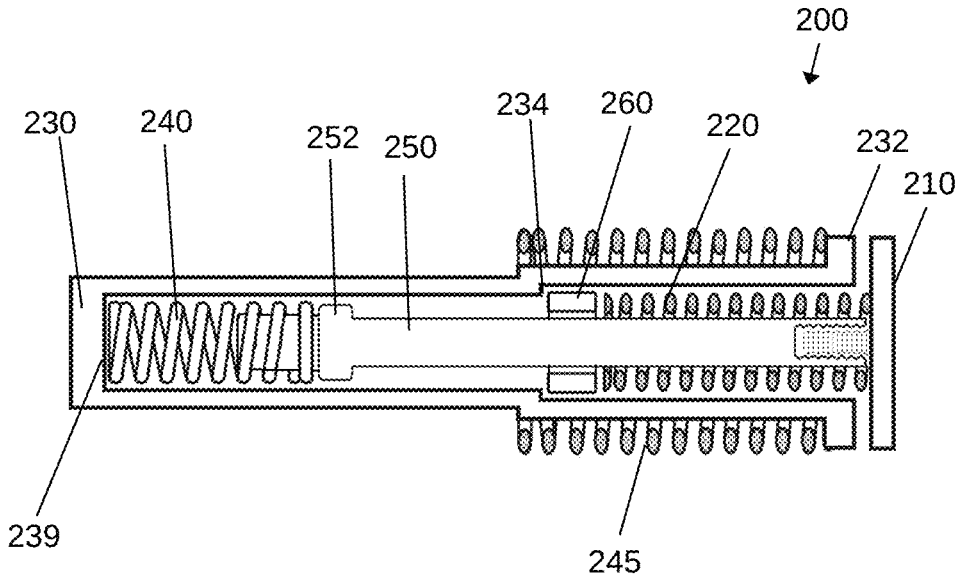
FIG. 6 is a side partial cut-away view of the assembled recoil mechanism according to the present disclosure shown in a compressed form.

Referring now to FIG. 5, an assembled version of the recoil mechanism 200 is shown (without the outer spring 245) with the springs 240 and 220 at rest as would occur prior to discharging the associated firearm in which the recoil mechanism 200 is mounted. The outer diameter of the enlarged portion 252 of rod 250 is narrower than the inner diameter of the narrower portion 238 of the hollow cylinder 230. The outer diameter of the small washer 260 is wider than the than the inner diameter of the narrower portion 238 of the hollow cylinder 230, so that the step 234 of the hollow cylinder 230 will exert pressure on the small washer 260 when the hollow cylinder 230 moves proximally towards endplate 210 (when endplate is held in a fixed position, as shown in FIG. 2 for example). This pressure will compress rod spring 220, as shown in FIG. 6, and as the hollow cylinder 230 moves closer to endplate 210, the inner spring 240 will also compress.

The recoil mechanism 200 of the present disclosure provides a number of advantages over prior solutions. The rod assembly 270 can be provided preassembled, so that only two subassemblies are needed: (1) the rod assembly 270 with the inner spring 240 mounted to the rod 250, (2) the hollow cylinder 230 with the outer spring 245 mounted thereon. This makes the recoil mechanism 200 easy to disassemble, clean and lubricate, particularly because the parts are simply pressed together. In addition, the easy disassembly and ease of access to the inner spring 240 and outer spring 245 makes the recoil mechanism 200 easy to reconfigure to a user's preferences by changing the specifications, e.g., length (coils) and strength (tension), of one or both of the springs 240, 245. Furthermore, the small number of parts means that the recoil mechanism 200 of the present disclosure is less expensive than prior solutions while still offering adjustability.

When the recoil mechanism 200 is installed in the slide 105, the springs 220 and 245 are under minimum compression. The inner spring 240 is positioned within the narrower portion 238 of hollow cylinder 230 but since the length of the inner spring 240 is shorter than the length of the narrower portion 238 of hollow cylinder 230, the inner spring 240 is not under any compression at all.

The operation of the recoil mechanism 200 upon firing is as follows:

An instant before the discharge of the firearm, the springs 220 and 245 are under minimum compression while the inner spring 240 is under zero compression. The front surface of the slide 105 under the barrel 110 and the front surface of the hollow cylinder 230 abut each other.

Upon firing, the force of the gases generated in the firearm-barrel and on the slide cause the slide to be violently set into rearward motion. This start of the recoil action compresses the outer spring 245 which pushes the hollow cylinder 230 to the rear. The rod spring 220 does not permit the hollow cylinder 230 to move immediately to recoil. The slide 105 continues its recoil until it hits the step 234 of the hollow cylinder 230.

At this point, the slide 105, the outer spring 245, and the hollow cylinder 230 recoil as an assembly which compresses the rod spring 220 because the step 234 engages with the small washer 260 which applies force to the rod spring 220. As the rod spring 220 compresses, the space within the narrower portion 238 of hollow cylinder 230 narrows as the rod 250 moves therein. This pushes the free end of the inner spring 240 towards the internal end surface 239 at the closed end of hollow cylinder 230. As the recoil of the slide 105 continues with decelerated movement, the inner spring 240 makes contact with the internal end surface 239 and the inner spring 240 begins to compress and absorb most of the rest of the recoil energy of the slide 105 until the inner spring 240 compresses to its maximum extent. At a completion of the cycle, the member 124 on the slide 105 contacts the frame 130, and, since the gas expansion has been completed, the hollow cylinder 230 and the slide 105 begin to move in the opposite direction with the forces of the three springs 220, 240 and 245 pushing the slide 105 and the hollow cylinder 230 back to the rest position.

Figure 7:
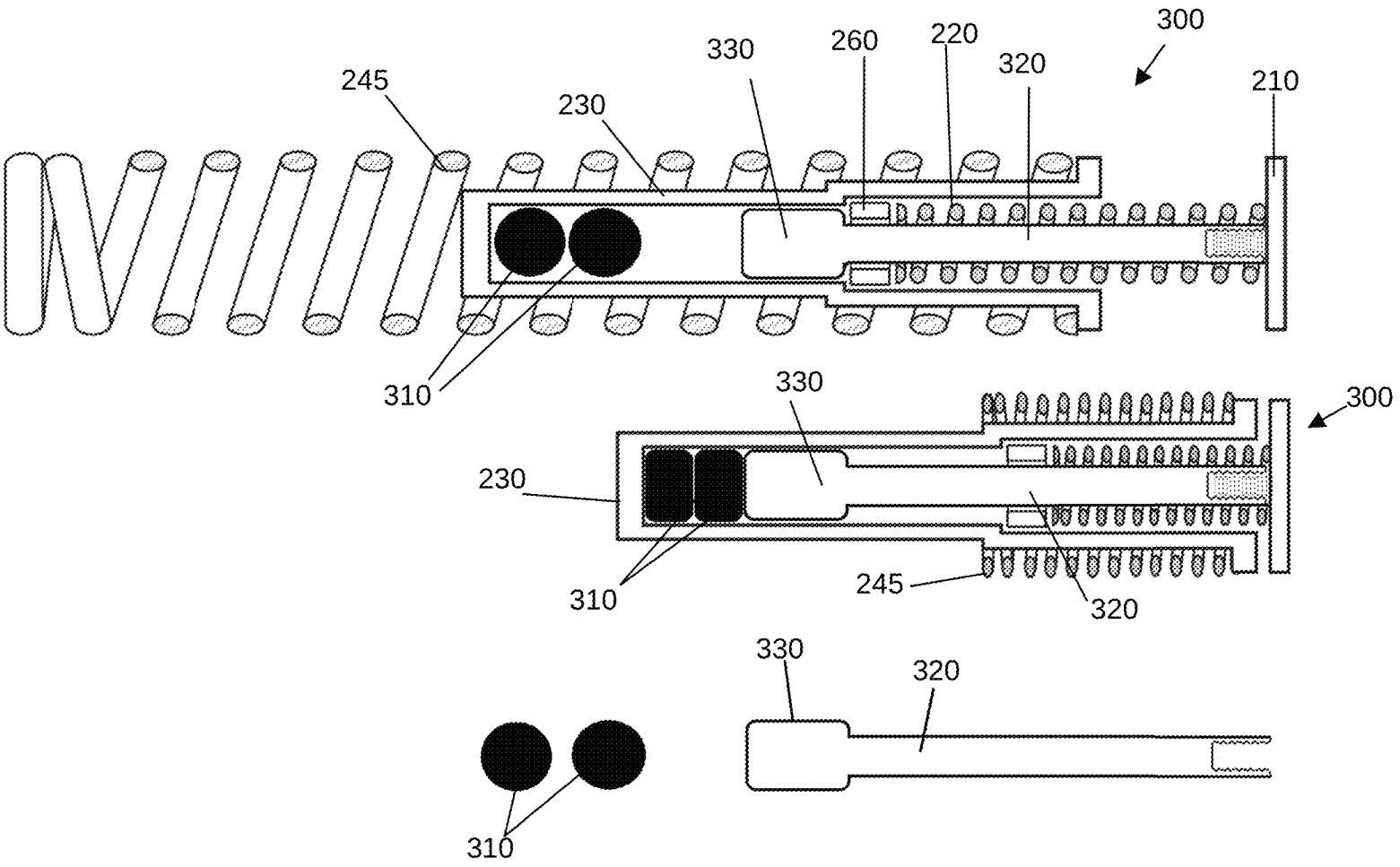
FIG. 7 is a diagram showing side partial cut-away views of a recoil mechanism according to a second embodiment of the present disclosure.

Referring now to FIG. 7, in an alternative embodiment, a recoil mechanism 300 includes one or more compliant balls 310 (two are shown in FIG. 7) instead of the inner spring 240 used in the first embodiment shown in FIGS. 1 to 6. The compliant balls 310 may be formed from rubber or polyurethane having predetermined elastic properties. By adjusting the elastic properties, different forces may be provided by the recoil mechanism. The rod 350 is slightly different than the rod 250 employed in the first embodiment, with an enlarged portion 330 having a diameter slightly less than the inner diameter of the narrower portion of hollow cylinder 230. The enlarged portion 330 extends to the distal end of the rod 350 in order to provide a wider surface to contact the closest ball 310 thereto in order to ensure that adequate compression forces are applied to the balls 310. The compression of the balls 310 is shown in the middle portion of FIG. 7. The recoil mechanism 300 works in the same manner as recoil mechanism 200 of the first embodiment, with the compliant balls 310 providing the same function as the inner spring 240 of the first embodiment at the end of slide travel position.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A recoil mechanism for a firearm having a barrel and a slide, the recoil mechanism comprising:

a hollow cylinder having a closed end and an open end, the hollow cylinder having a first portion adjacent to the closed end having a first inner diameter and a second portion adjacent to the open end having a second inner diameter, the second inner diameter larger than the first inner diameter, the hollow cylinder having an outwardly facing flange at the open end thereof;

an outer spring positioned over the hollow cylinder and having a first end for mounting against a surface of the slide and a second end in contact with the outwardly facing flange of the hollow cylinder; and a rod assembly that includes:

a rod having a first end and a second end, the rod coupled to an endplate at the first end thereof, the rod having an enlarged portion towards the second end thereof;

a small washer having an internal diameter smaller than a diameter of the enlarged portion of the rod and an outer diameter larger than the first inner diameter of the first portion of the hollow cylinder and smaller than the second inner diameter of the second portion of the hollow cylinder, the small washer mounted on the rod between the enlarged portion and the endplate;

a rod spring mounted over the rod between the small washer and the endplate; and wherein the rod assembly is positioned within the hollow cylinder by inserting the second end of the rod into the open end of the hollow cylinder.

2. The recoil mechanism of claim 1, wherein the rod assembly comprises an inner spring having a first end mounted over the second end of the rod.

3. The recoil mechanism of claim 2, wherein the rod has a slot thereon between the second end and the enlarged portion thereof, the slot adapted to hold an end coil of the inner spring so that the inner spring is secured to the rod.

4. The recoil mechanism of claim 1, wherein the endplate has a threaded extension on one side thereof and the rod has a threaded aperture at the first end thereof, and the endplate being coupled to the rod by mating the threaded extension of the endplate to the threaded aperture of the rod.

5. The recoil mechanism of claim 1, comprising at least one compliant ball positioned within the hollow cylinder adjacent to the closed end.

6. The recoil mechanism of claim 5, wherein the enlarged portion of the rod extends to the second end thereof.

7. The recoil mechanism of claim 5, wherein the at least one compliant ball is formed from rubber or polyurethane having a predetermined elastic property.

8. The recoil mechanism of claim 1, comprising a plurality of compliant balls positioned within the hollow cylinder adjacent to the closed end.

9. The recoil mechanism of claim 8, wherein the enlarged portion of the rod extends to the second end thereof.

10. The recoil mechanism of claim 8, wherein the plurality of compliant balls are formed from rubber or polyurethane having a predetermined elastic property.

11. A firearm, comprising:

a barrel;

a slide; and a recoil mechanism comprising:

a hollow cylinder having a closed end and an open end, the hollow cylinder having a first portion adjacent to the closed end having a first inner diameter and a second portion adjacent to the open end having a second inner diameter, the second inner diameter larger than the first inner diameter, the hollow cylinder having an outwardly facing flange at the open end thereof;

an outer spring positioned over the hollow cylinder and having a first end for mounting against a surface of the slide and a second end in contact with the outwardly facing flange of the hollow cylinder; and a rod assembly that includes:

a rod with a first end and a second end, the rod coupled to an endplate at the first end thereof, the rod having an enlarged portion towards the second end thereof;

a small washer having an internal diameter smaller than a diameter of the enlarged portion of the rod and an outer diameter larger than the first inner diameter of the first portion of the hollow cylinder and smaller than the second inner diameter of the second portion of the hollow cylinder, the small washer mounted on the rod between the enlarged portion and the endplate;

a rod spring mounted over the rod between the small washer and the endplate; and wherein the rod assembly is positioned within the hollow cylinder by inserting the second end of the rod into the open end of the hollow cylinder.

12. The firearm of claim 11, wherein the rod assembly comprises an inner spring having a first end mounted over the second end of the rod.

13. The firearm of claim 12, wherein the rod has a slot thereon between the second end and the enlarged portion thereof, the slot adapted to hold an end coil of the inner spring so that the inner spring is secured to the rod.

14. The firearm of claim 11, wherein the endplate has a threaded extension on one side thereof and the rod has a threaded aperture at the first end thereof, and the endplate being coupled to the rod by mating the threaded extension of the endplate to the threaded aperture of the rod.

15. The firearm of claim 11, comprising at least one compliant ball positioned within the hollow cylinder adjacent to the closed end.

16. The firearm of claim 15, wherein the enlarged portion of the rod extends to the second end thereof.

17. The firearm of claim 15, wherein the at least one compliant ball is formed from rubber or polyurethane having a predetermined elastic property.

18. The firearm of claim 11, comprising a plurality of compliant balls positioned within the hollow cylinder adjacent to the closed end.

19. The firearm of claim 18, wherein the enlarged portion of the rod extends to the second end thereof.

20. The firearm of claim 18, wherein the plurality of compliant balls are formed from rubber or polyurethane having a predetermined elastic property.

* * * * *